US007303509B2

(12) United States Patent
Schroder

(10) Patent No.: US 7,303,509 B2
(45) Date of Patent: Dec. 4, 2007

(54) EXERCISE MACHINE

(76) Inventor: Mitchell J. Schroder, 4977 E. 169th St., Noblesville, IN (US) 46060

( * ) Notice: Subject to any disclaimer, the term of this patent is extended or adjusted under 35 U.S.C. 154(b) by 0 days.

(21) Appl. No.: 11/421,974

(22) Filed: Jun. 2, 2006

(65) Prior Publication Data

US 2006/0217235 A1 Sep. 28, 2006

Related U.S. Application Data

(63) Continuation-in-part of application No. 10/730,409, filed on Dec. 8, 2003, now abandoned.

(51) Int. Cl.
*A63B 22/02* (2006.01)

(52) U.S. Cl. ..... 482/52; 482/57

(58) Field of Classification Search ..... 482/51–52, 482/57, 70, 79–80

See application file for complete search history.

(56) References Cited

U.S. PATENT DOCUMENTS

| | | | |
|---|---|---|---|
| 5,108,093 | A | 4/1992 | Watterson |
| 5,562,572 | A | 10/1996 | Carmein |
| 5,836,855 | A | 11/1998 | Eschenbach |
| 5,868,650 | A | 2/1999 | Wu |
| 6,042,512 | A | 3/2000 | Eschenbach |
| 6,045,488 | A | 4/2000 | Eschenbach |
| 6,063,009 | A | 5/2000 | Stearns |
| 6,090,013 | A | 7/2000 | Eschenbach |
| 6,123,650 | A | 9/2000 | Birrell |
| 6,146,313 | A | 11/2000 | Whan-Tang |
| 6,190,289 | B1 | 2/2001 | Pyles |
| 6,196,948 | B1 | 3/2001 | Stearns et al. |
| 6,238,321 | B1 | 5/2001 | Arnold et al. |
| 6,361,476 | B1 | 3/2002 | Eschenbach |
| 6,422,977 | B1 | 7/2002 | Eschenbach |
| 6,440,042 | B2 | 8/2002 | Eschenbach |
| 6,554,750 | B2 | 4/2003 | Stearns |
| 6,565,486 | B2 | 5/2003 | Stearns |
| 6,663,540 | B1 | 12/2003 | Huang |
| 6,918,859 | B1 | 7/2005 | Yeh |

*Primary Examiner*—Stephen R. Crow
(74) *Attorney, Agent, or Firm*—C. John Brannon; Sommer Barnard PC

(57) ABSTRACT

An elliptical exercise machine, including a gearbox, a generally flat contact surface, a first elongated footrest support member mechanically coupled to the gearbox and extending to the flat contact surface, a second elongated footrest support member mechanically coupled to the gearbox and extending to the flat contact surface, and an elastic coupler removably connected between the first and second elongated footrest support member. The contact surface is generally flat and described by a first axis and a second orthogonally oriented axis. The gearbox independently governs the motive resistance and travel path of each footrest support members. The each footrest support member rollingly cooperates with the contact surface, and each first and second elongated footrest support member may cooperate with the support surface independently of the other respective footrest support member. Each footrest support member is free to move in the plane of the flat contact surface, i.e., each footrest support member is able to move in two dimensions and is not restricted to one dimensional, "back and forth" motion.

19 Claims, 12 Drawing Sheets

106

EXERCISE MACHINE

REFERENCE TO RELATED APPLICATION

The present application is a continuation-in-part application claiming priority to, and based upon, U.S. patent application Ser. No. 10/730,409, filed Dec. 8, 2003 now abandoned.

TECHNICAL FIELD

The claimed technology relates generally to exercise machines and, more particularly, to an elliptical crosstraining apparatus having footrest support members that are functionally decoupled from one another.

BACKGROUND

Elliptical exercise training is a relatively new and popular exercise option. In elliptical training, exercisers use elliptical running machines to get a total-body workout and improve muscle tone and cardiovascular fitness, at health clubs and gymnasiums or in the privacy of their own homes. Elliptical running machines include footpads affixed to support members that may move both back and forth and up and down to accommodate a walking or running motion by the exerciser. Elliptical running machines provide high-intensity, low-impact exercise because the feet never leave the footpads. Impact forces in the feet are decreased relative to traditional running or jogging (even on treadmills), resulting in fewer orthopedic injuries to the ankles, knees and hips. The exerciser's feet are typically guided through the exercise movement with large, stable footrests. These movements are designed for aerobic benefit, and the resistance of the support members can be adjusted to be easy enough for someone just starting out, and challenging enough for a more seasoned athlete.

However, known elliptical running machines suffer from a number of shortcomings. First, the stride length is typically nonadjustable, and is determined by the placement of the footrests and the lengths of the support members. While generally positioned to be optimal for exercisers of average height, the predetermined stride length may be uncomfortable or even hazardous for those exercisers having heights substantially taller or shorter than average.

Second, known elliptical running machines only allow for exercisers to mimic walking and running motions. The elliptical machines cannot be used to provide non-impact emulations of other exercises, such as skiing or skating.

Therefore, there exists a need for improved elliptical exercise machines that will emulate exercises more complex than running, such as skiing and/or skating. The claimed technology addresses this need.

SUMMARY

The claimed technology relates to an improved elliptical crosstraining apparatus wherein the footrest support members are functionally decoupled from one another. One object is to provide an improved elliptical crosstraining apparatus. Related objects and advantages of the claimed technology will be apparent from the following description.

DESCRIPTION OF THE PREFERRED EMBODIMENTS

Figure 1:
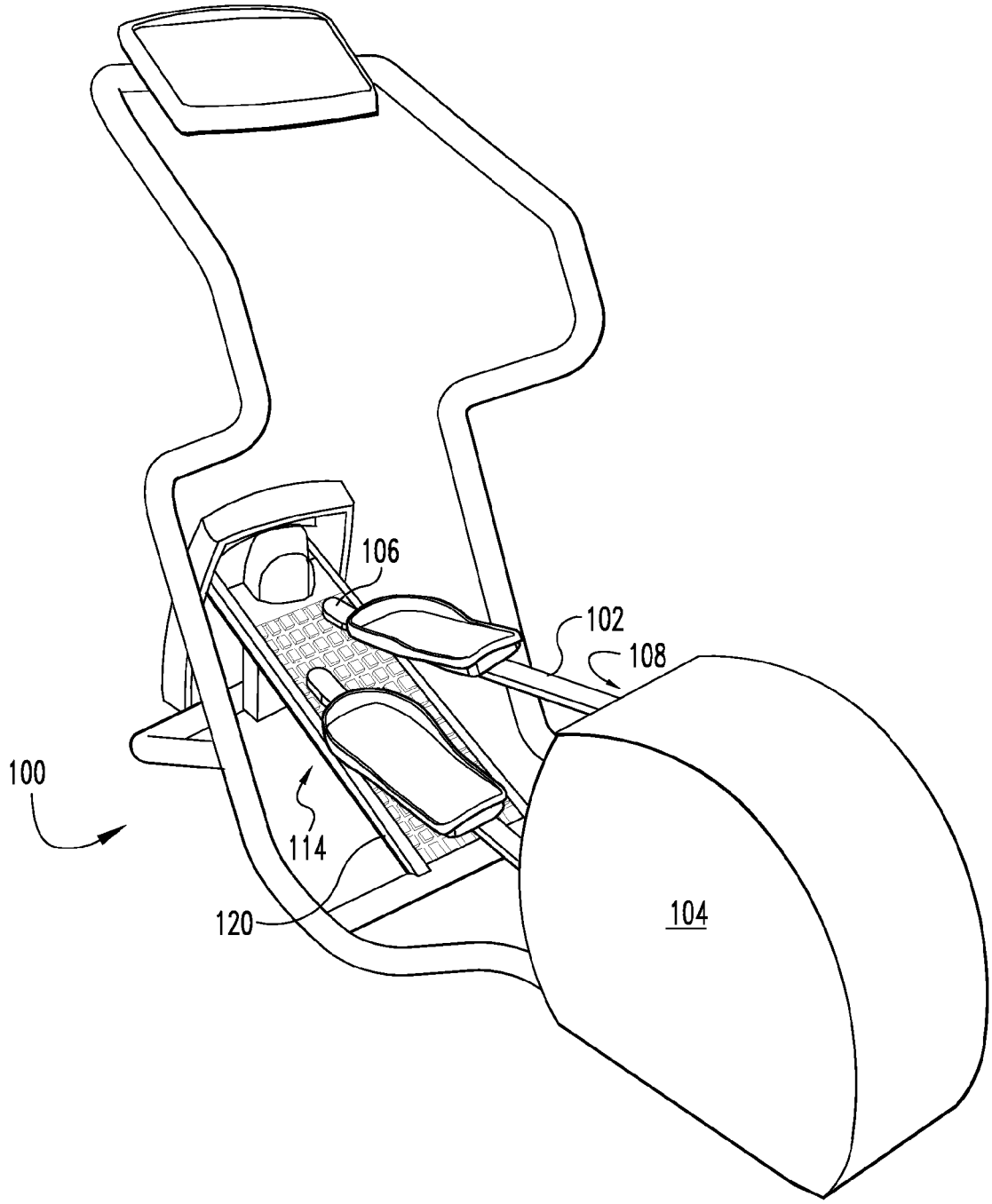
FIG. 1 is a perspective view of a first embodiment elliptical crosstraining apparatus of the claimed technology.
Figure 2A:
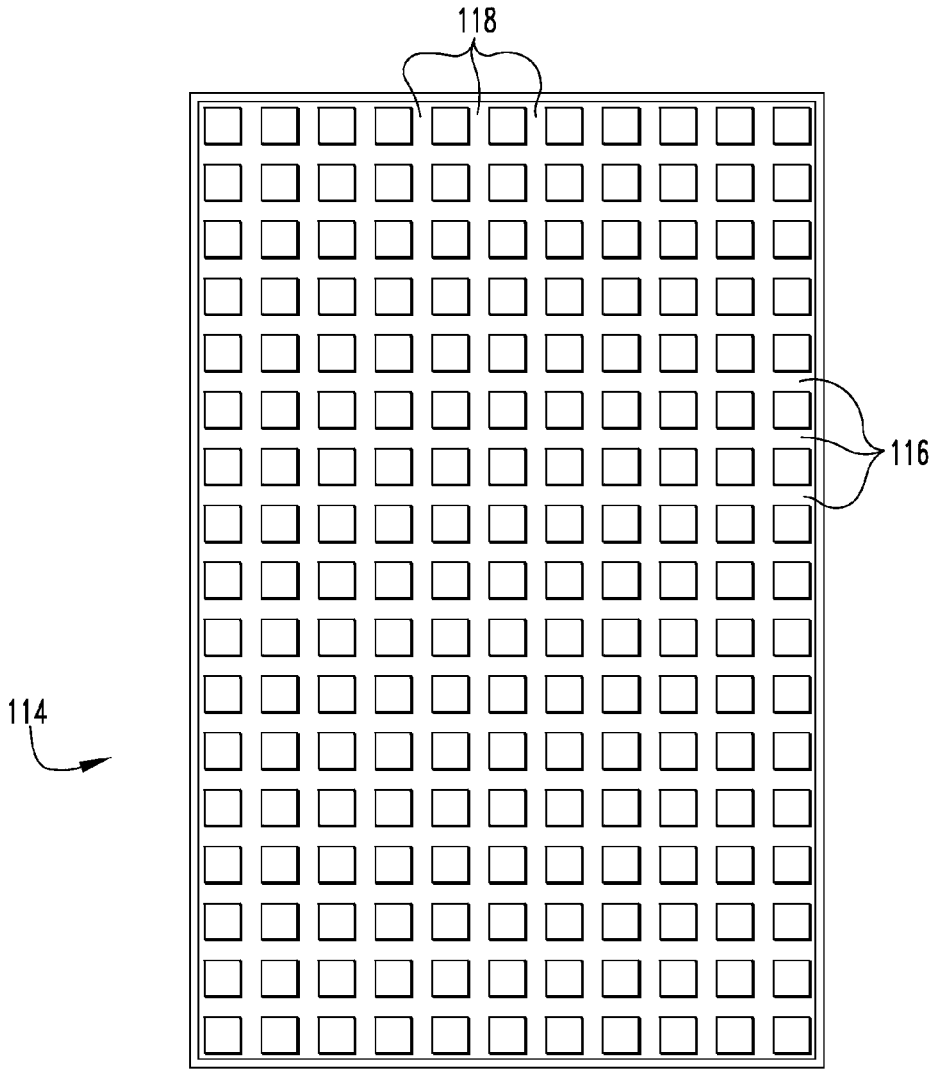
FIG. 2 is a top plan view of a flat contact surface portion of the embodiment of FIG. 1.
Figure 2B:
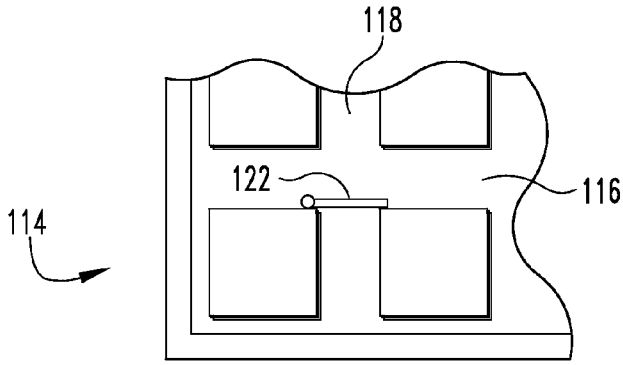
Figure 3:
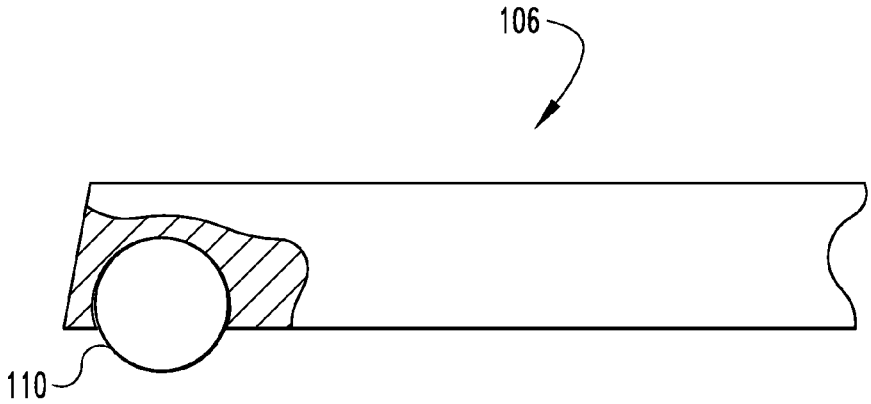
FIG. 3 is a partial side cut-away view of a support member of FIG. 1.
Figure 4A:
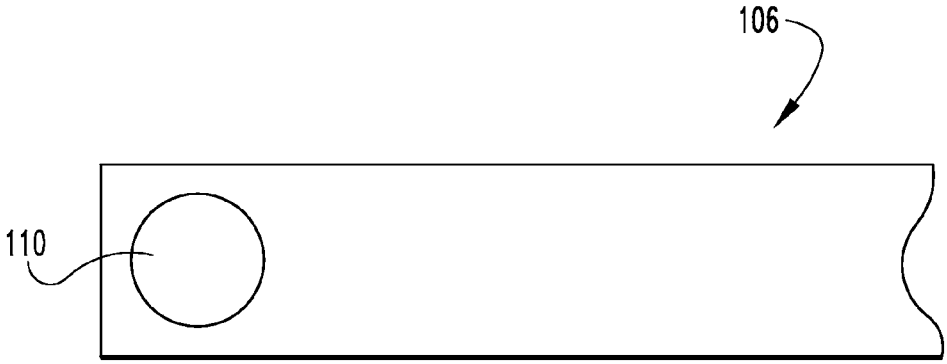
FIG. 4A a partial bottom plan view of a support member of FIG. 1.
Figure 4B:
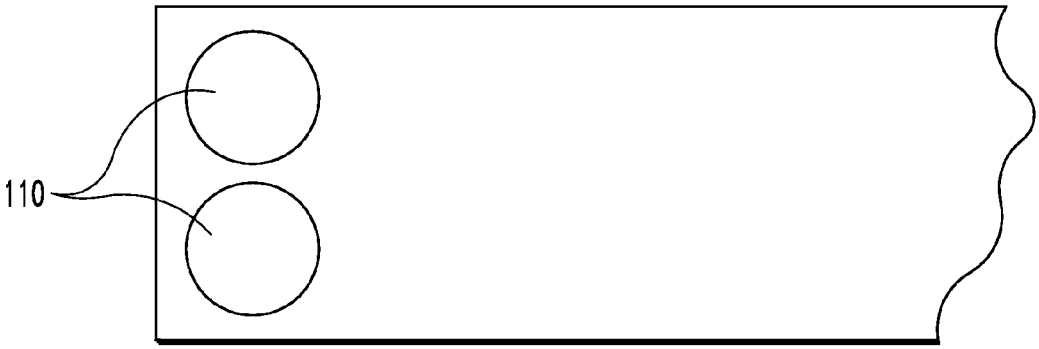
FIG. 4B a partial bottom plan view of an alternate support member of FIG. 4A having multiple bearings.
Figure 5A:
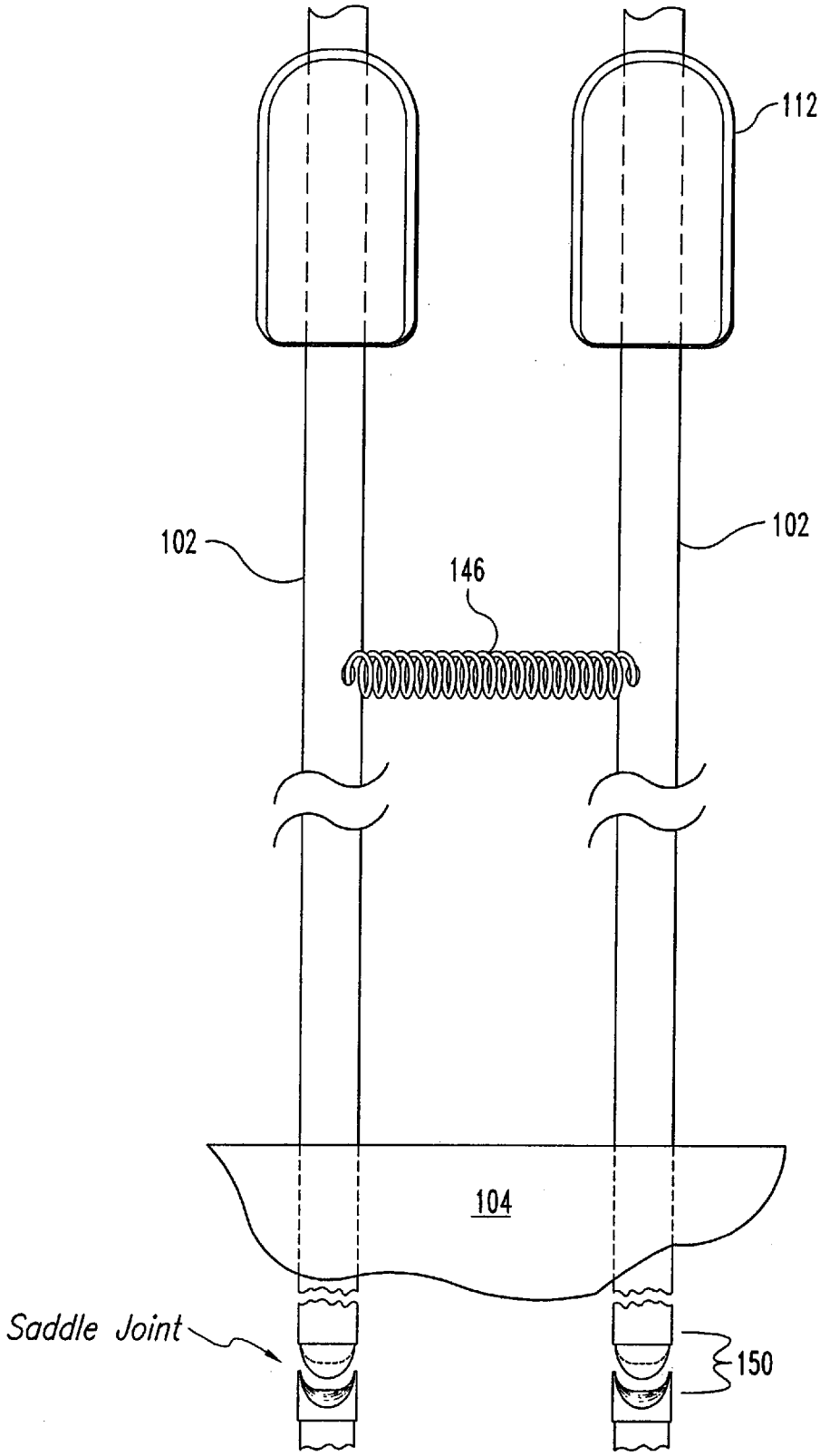
FIG. 5A is a partial top plan view of FIG. 1 wherein the joint connecting the elongated footrest support members is a saddle joint.
Figure 5B:
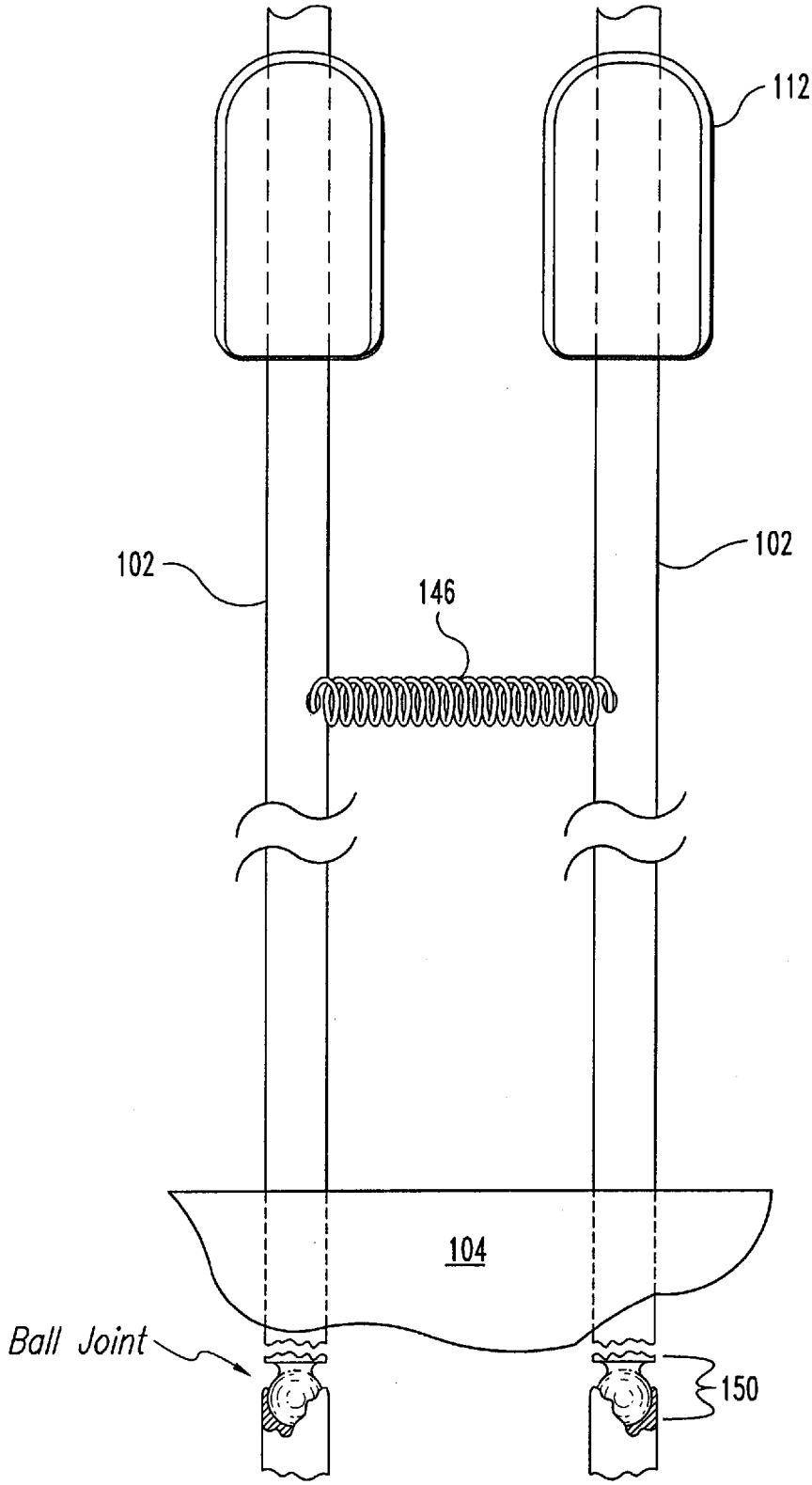
FIG. 5B is a partial top plan view of FIG. 1 wherein the joint connecting the elongated footrest support members is a ball joint.
Figure 5C:
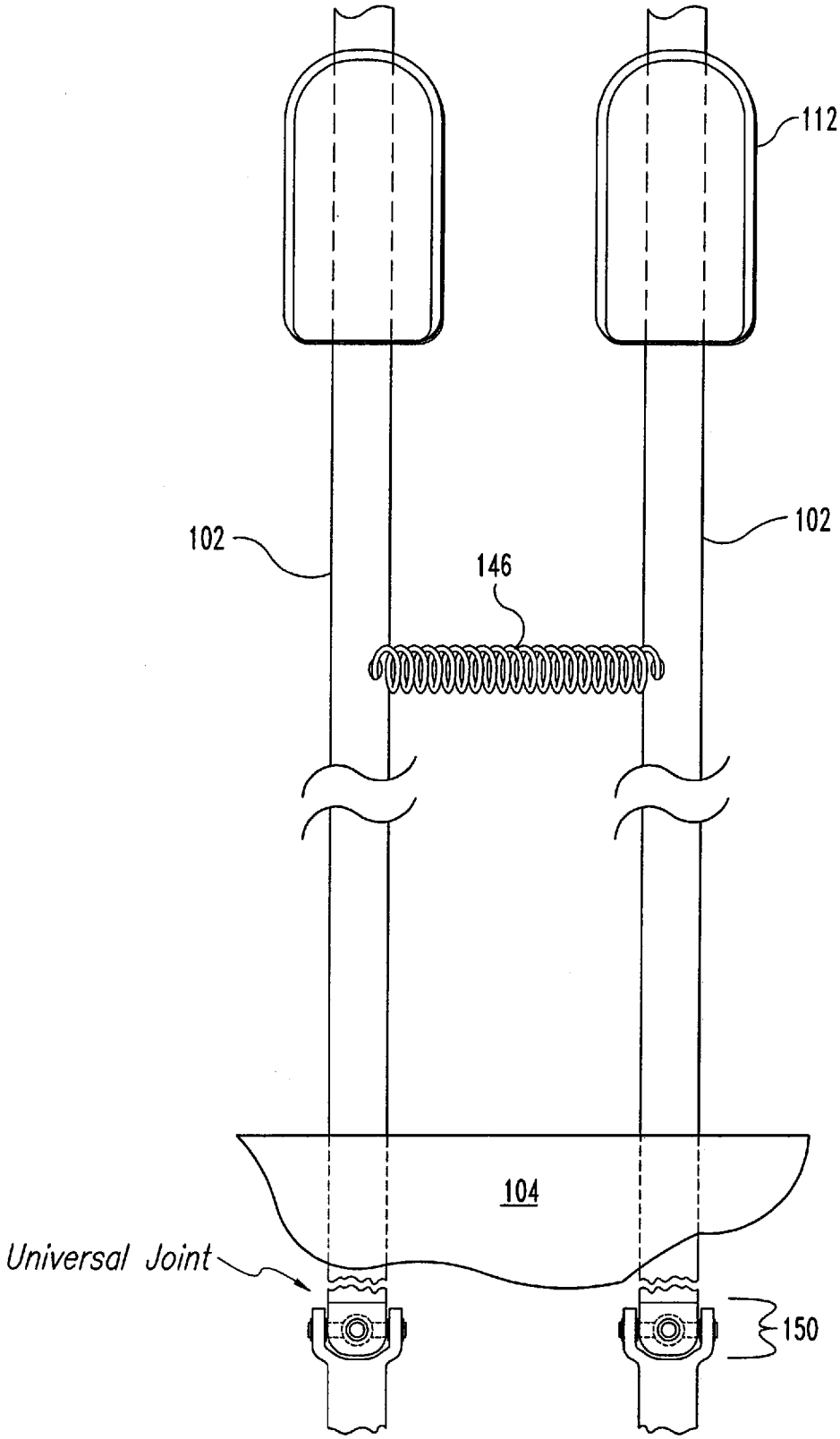
FIG. 5C is a partial top plan view of FIG. 1 wherein the joint connecting the elongated footrest support members is a double-universal joint.
Figure 6A:
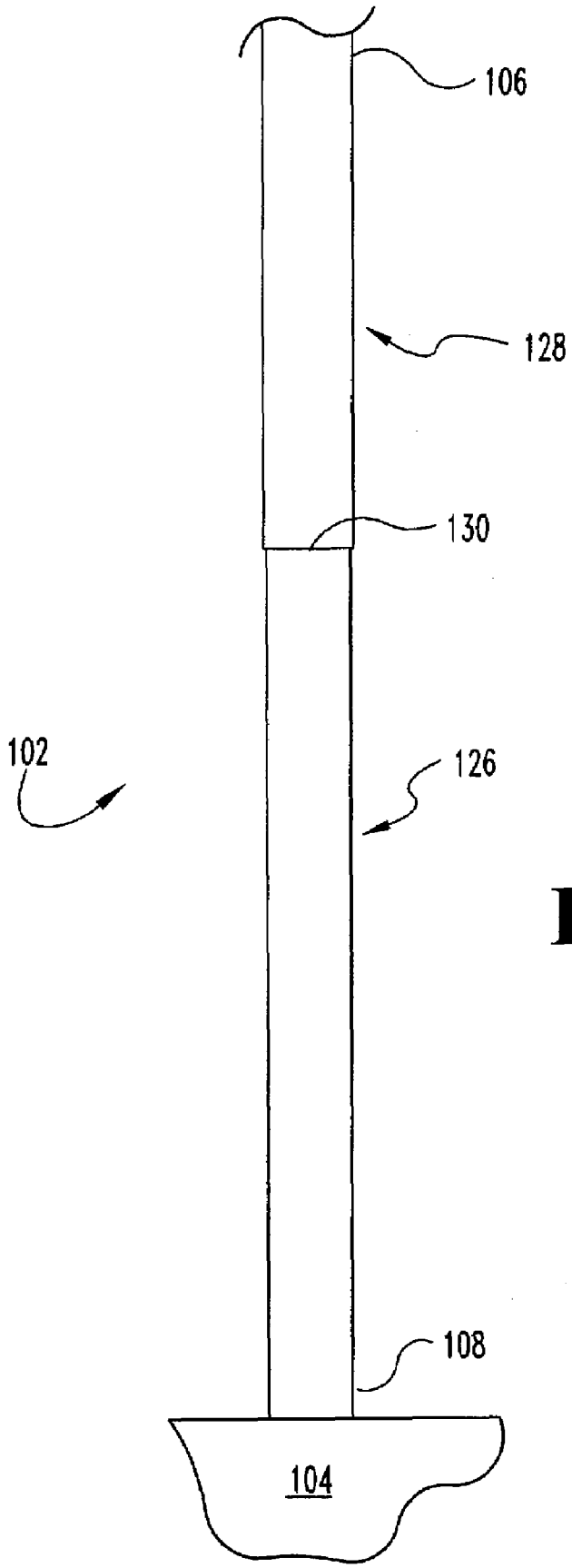
FIG. 6A is a partial top plan view of a support member of FIG. 5.
Figure 6B:
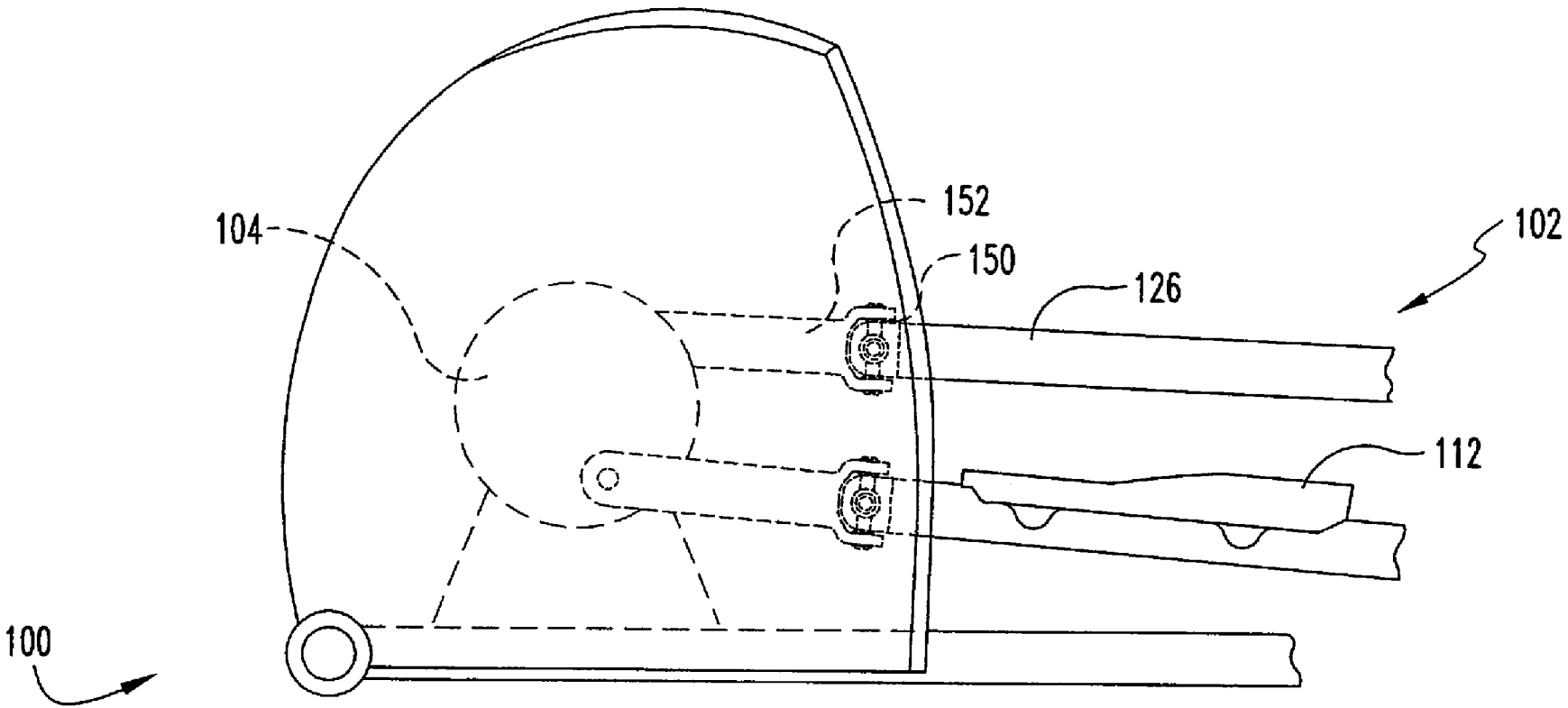
FIG. 6B is a partial side cutaway view of FIG. 1.
Figure 7A:
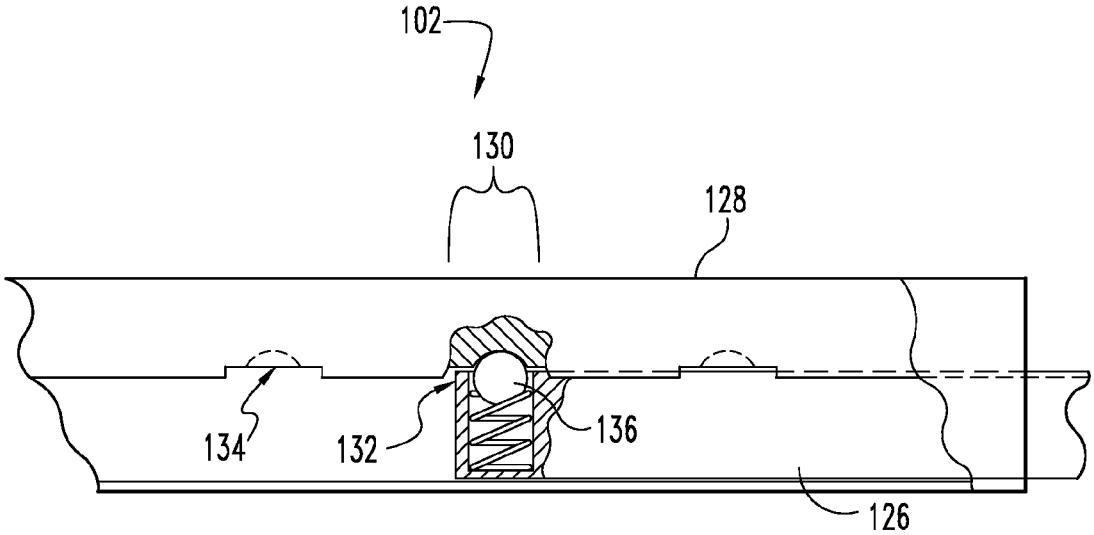
FIG. 7A is a partial side cutaway view of FIG. 6A.
Figure 7B:
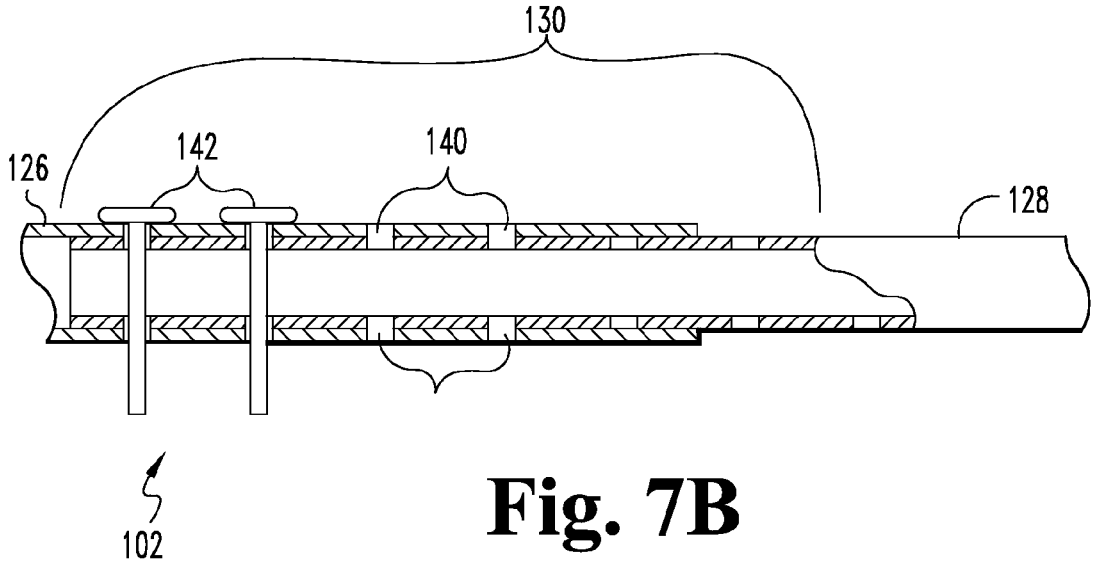
FIG. 7B is a partial side cutaway view of an alternate support member of FIG. 7A.

For the purposes of promoting an understanding of the principles of the claimed technology and presenting its currently understood best mode of operation, reference will now be made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would normally occur to one skilled in the art to which the claimed technology relates.

FIGS. 1-7B illustrate a first embodiment of the claimed technology, an elliptical crosstraining exercise apparatus 100 having non-coupled, independently operable footrest support members 102. The footrest support members 102 extend from a central mechanical unit or gearbox 104 (such as a set of cranks rotatable about respective independently pivoting armatures with respective linkages for connection with the respective footrest support members 102 or the like) such that the resistance and travel path of the footrest support members 102 is governed by the central mechanical unit 104. Typically, the resistance on the footrest support members 102 is variable.

Each footrest support member 102 has a distal end 106 and a proximal end 108 and further includes a contact portion 110 positioned at the distal end 106. In this embodiment, the contact portion 110 is one or more ball bearing operationally connected to the distal end 106, such that the contact portion 110 is relatively free to rotate relative to the footrest support member 102. Typically, a footrest portion 112 is connected near the distal end 106 of each respective footrest support member 102.

The contact portion 110 is configured to movably contact a flat contact surface member 114. The flat contact surface member 114 typically includes a first plurality of grooves or races 116 formed thereinto and sized to accept the contact portion 110 in rolling cooperation. The flat contact surface member 114 also typically includes a second plurality of grooves or races 118 formed thereinto, sized to accept the contact portion 110 in rolling cooperation, and typically oriented perpendicularly to the first plurality of races 116. In other words, the first and second plurality of races 116, 118 typically form a two-dimensional grid (i.e., a grid defined by a first and a second non-colinear axis, wherein the axes are typically orthogonally oriented respective to each other) determining the possible travel pathways of each bearing, and thus of each footrest support member 102. It is thus possible for each footrest support member 102 to be moved along one or both axes; it is further possible for both footrest support members 102 to be moved within over the two dimensional surface member 114 independently of the other respective support member 102.

The flat contact surface member 114 is typically angled (relative the horizontal surface the apparatus rests upon) to provide an incline for the footrest support members 102 to traverse. More typically, the contact angle between the flat surface contact member 114 and the horizontal is variable. In other words, the flat surface contact member 114 is typically movably connected to the body of the apparatus 100. Also typically, the flat support surface member 114 includes siderails 120 to prevent the contact portions 110 from moving beyond the flat support surface 114.

Typically, valve members 122 may be operably connected to the races 116, 118 to limit or restrict the pathways available to the contact portions 110.

Also typically, the footrest support members 102 are of variable length. In one embodiment, each footrest support member 102 includes a first portion 126 extending from the central mechanical unit 104 and a second portion 128 (typically lockingly) connectable to the first portion 126 and extending to the flat surface contact member 114. The first and second portions 126, 128 connect at a joint 130. The joint 130 is typically formed by the connection of a protrusion 132 formed at the joining end of one portion 126, 128 and one of a plurality of recesses 134 sized to accept the protrusion 132 and formed in the other member 128, 126. (See FIG. 7A.) Typically, the protrusion 132 includes a latching portion 136, such as a spring biased wheel or ball. More typically, the protrusion 132 is positioned to extend downwardly into its matching recess 134. Alternately, the end of one portion 126, 128 may include a plurality of apertures 140 formed therethrough and be sized to slip into the hollow end of the other portion 128, 126, which also includes at least one aperture 140 formed therethrough. (See FIG. 7B.) One or more pins 142 may be slipped through both portions when the apertures 140 are aligned to form a joint 130.

FIGS. 5A-6B illustrate in detail the pivitable connection of the first portion 126 of the respective support members 102 to the central mechanical unit 104. Each first portion 126 is connected to a joint 150 that allows pivotable or limited rotational movement of the first portion 102. The joint may be connected directly to the central mechanical unit 104 or may be connected thereto by an elongated connection member 152. The joint 150 may be a saddle joint (see FIG. 5A), a ball joint (see FIG. 5B), a single or double universal joint (see FIG. 5C), or the like. The degree to which the first member 126 may pivot or rotate relative the central mechanical unit 104 may be controlled by the configuration of the joint 150. The first member 126 may pivot or rotate in both the horizontal and vertical planes; in other words, the first member 126 enjoys freedom of movement through at least a conical section of space extending from the joint 150 toward the footrest surface member 114.

Typically, a detachable biasing member 146, such as one or more elastic straps, springs, pneumatic or hydraulic cylinders, or the like, extend between the two footrest support members 102 to couple the footrest support members 102 to help facilitate the emulation of running. Removal of some or all of the biasing members 146 partially or completely decouples the support members 102, enabling the apparatus 100 to emulate such exercises as skiing or skating. Partial removal of the biasing members 146, or replacement of a stiffer biasing member 146 with a looser biasing member 146, partially decouples the support members 102, while adding additional or stiffer biasing members 146 increases the coupling of the support members 102, thus enabling an athlete to decrease or increase the resistance of the device 100 and thus vary the level of difficulty of the workout to taste.

Figure 8:
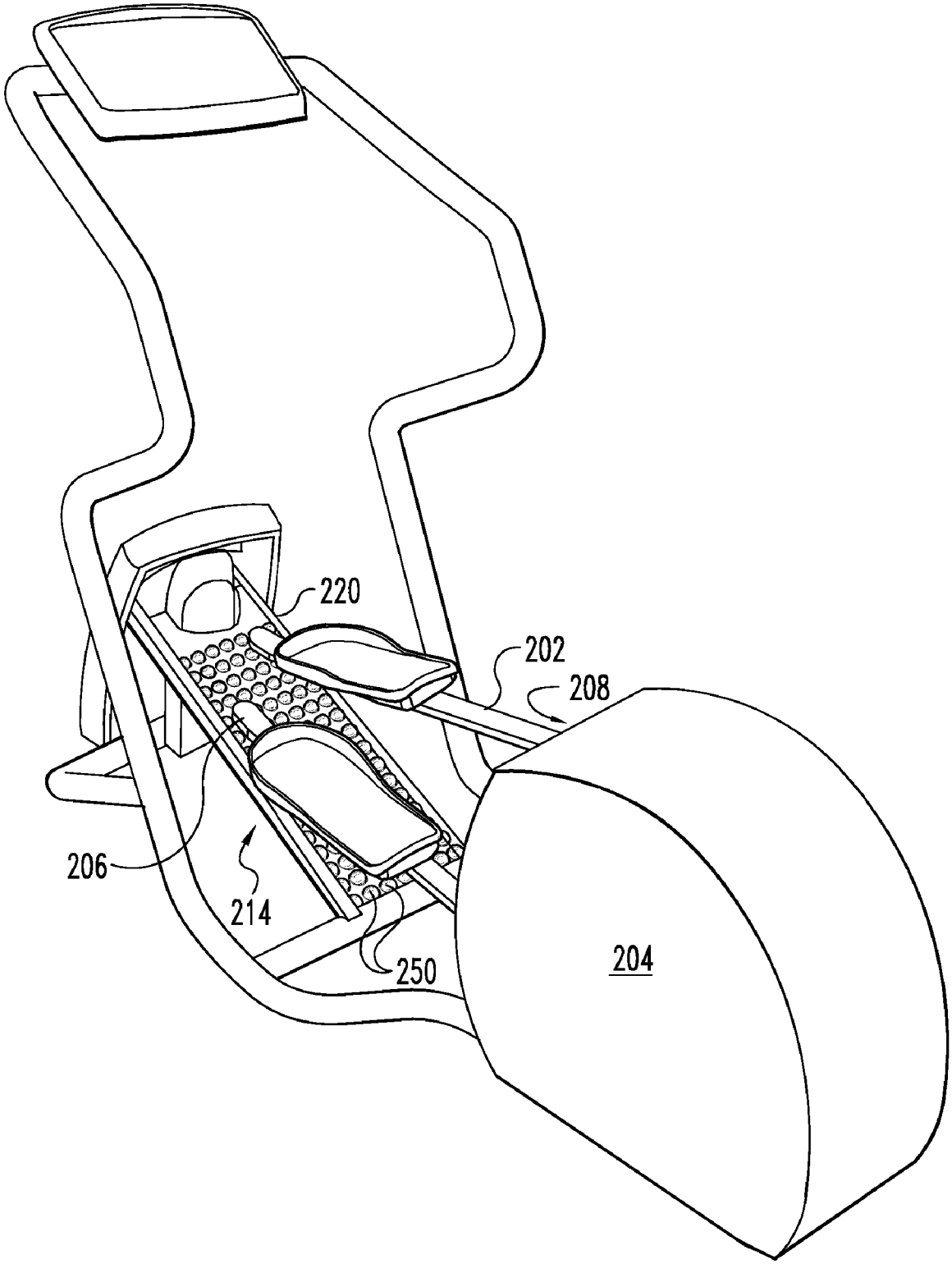
FIG. 8 is a perspective view of a second embodiment elliptical crosstraining apparatus of the claimed technology.
Figure 9:
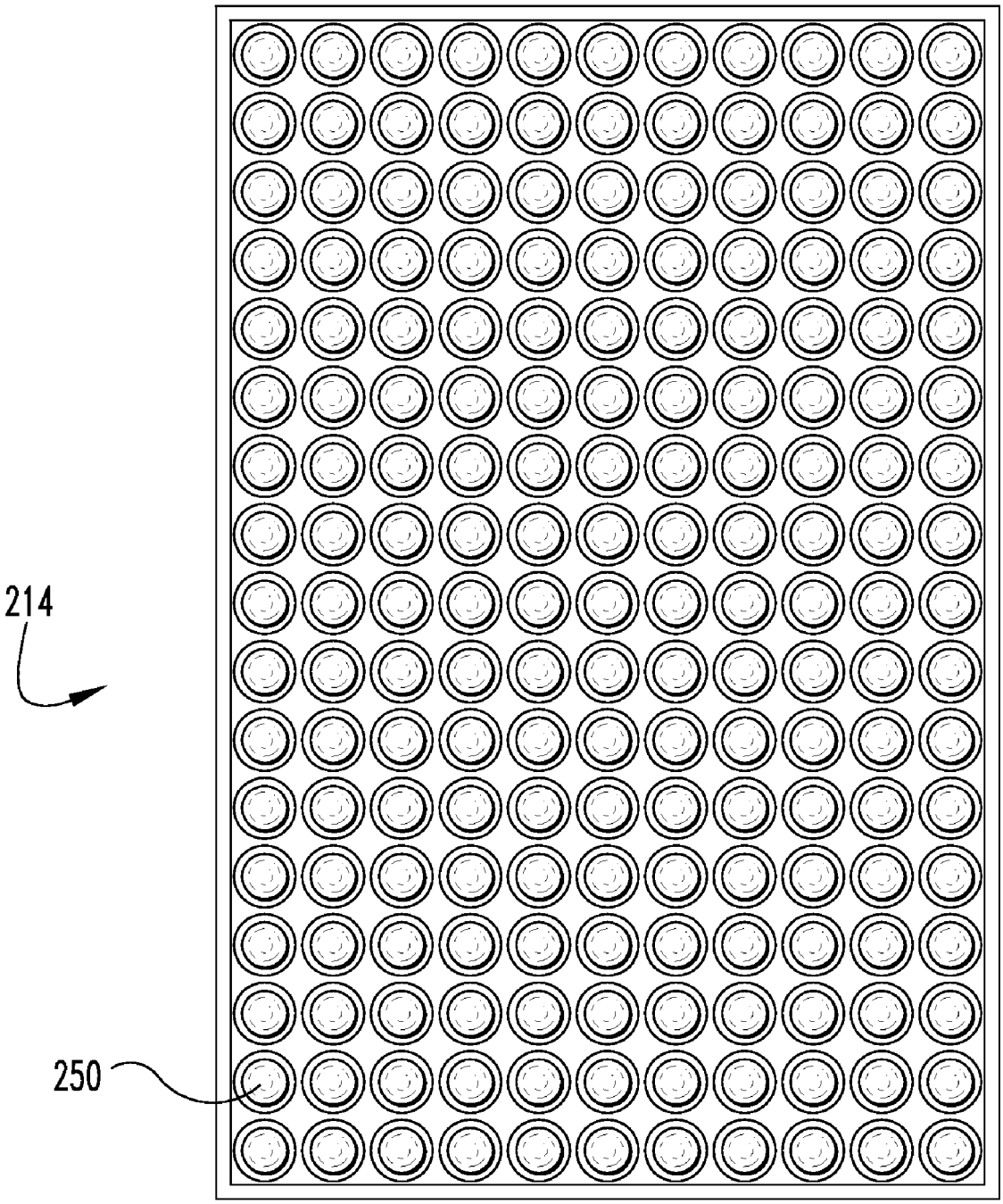
FIG. 9 is a top plan view of a flat contact surface portion of the embodiment of FIG. 8.
Figure 10:
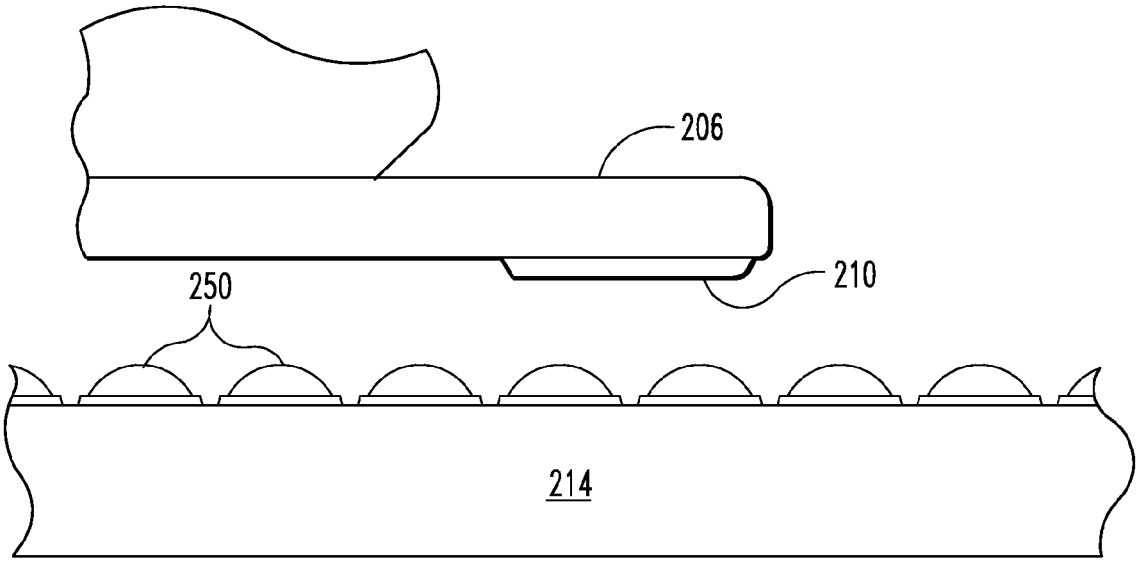
FIG. 10 is an enlarged partial side elevational view of a support member and the flat contact portion of FIG. 8.

FIGS. 8-10 describe a second embodiment exercise apparatus 200 of the claimed technology. The second embodiment apparatus 200 is similar to the first embodiment described above, with the exception that the flat support surface member 214 includes an array of rotatable contact members 250 (such as ball bearings) coupled thereto and the contact surfaces 210 of the footrest support members 202 are substantially flat. The contact surfaces 210 intersect the array of rotatable contact members 210 (ball bearings) to relatively freely rollably move over the flat support surface member 214.

While the claimed technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the claimed technology are desired to be protected.

I claim:

1. An exercise apparatus, comprising in combination:

a central mechanical portion;

a flat contact surface;

a first footrest support member extending from the central mechanical portion to the flat contact surface;

a second footrest support member extending from the central mechanical portion to the flat contact surface;

a biasing member connected between the first and second footrest support members;

wherein the respective footrest support members are pivotably coupled to the central mechanical portion;

wherein the respective footrest support members may pivot both horizontally and vertically;

wherein the central mechanical portion controls the motive resistance and defines the travel path of the footrest support member; and wherein the footrest support members rollingly cooperate with substantially the entire contact surface; wherein each footrest support member moves in an elliptical path of motion during use.

2. The exercise apparatus of claim 1 wherein each respective footrest support member has a respective proximal end coupled to the central mechanical portion and a respective distal end; wherein the respective distal end includes a respective roller bearing rollingly coupled thereto; wherein the contact surface includes a plurality of intersecting races formed therein; and wherein the races are sized to receive the respective roller bearing.

3. The exercise apparatus of claim 1 wherein each respective footrest support member has a respective proximal end coupled to the central mechanical portion and a respective distal end; wherein the respective distal end includes a generally flat contact portion; and wherein the contact surface includes a plurality of roller bearings rollingly coupled thereto.

4. The exercise apparatus of claim 1 wherein each respective footrest support member further comprises a respective first portion and a respective second portion and wherein the respective first portion and respective second portion interlockingly connect to define a respective joint.

5. The exercise apparatus of claim 1 wherein each respective footrest support member is pivotably coupled to the central mechanical portion via a ball joint.

6. The exercise apparatus of claim 1 wherein each respective footrest support member is pivotably coupled to the central mechanical portion via a saddle joint.

7. The exercise apparatus of claim 1 wherein each respective footrest support member is pivotably coupled to the central mechanical portion via a double universal joint.

8. An elliptical exercise machine, comprising in combination:

a gearbox;

a first joint connected to the gearbox;

a second joint connected to the gearbox;

a generally flat contact surface;

a first elongated footrest support member rotatably coupled to the first joint and extending to the flat contact surface;

a second elongated footrest support member rotatably coupled to the second joint and extending to the flat contact surface; and an elastic coupler removably connected between the first and second elongated footrest support member;

wherein the contact surface is generally described by a first axis and a second orthogonally oriented axis;

wherein the gearbox independently governs the motive resistance and travel path of each footrest support members;

wherein the each footrest support member rollingly cooperates with the contact surface;

wherein the first and second elongated footrest support members may cooperate with the contact surface independently of each other may move in horizontal and vertical directions; and wherein each respective footrest support member may cooperate along the first axis and the second axis; wherein each footrest support member moves in an elliptical path of motion during use.

9. The exercise machine of claim 8 wherein the first and second joints are double universal joints.

10. The exercise machine of claim 8 wherein the first and second joints are ball joints.

11. The exercise machine of claim 8 wherein the first and second joints are saddle joints.

12. The exercise apparatus of claim 8 wherein each footrest support member has a proximal end coupled to the gearbox and a distal end; wherein the distal end includes a roller bearing rotatably coupled thereto; wherein the contact surface includes a plurality of intersecting races formed therein; and wherein the races are sized to receive the roller bearing.

13. The exercise apparatus of claim 8 wherein each footrest support member has a proximal end coupled to the gearbox and a distal end; wherein the distal end includes a generally flat contact portion; and wherein the contact surface includes an array of roller bearings operationally coupled thereto.

14. An elliptical exercise machine, comprising in combination:

a gearbox;

a generally flat contact surface;

a first rotatable joint coupled to the gearbox;

a second rotatable joint coupled to the gearbox;

a first elongated footrest support member rotatably coupled to the first rotatable joint and extending to the flat contact surface;

a second elongated footrest support member rotatably coupled to the second rotatable joint and extending to the flat contact surface; and an elastic coupler removably connected between the respective elongated footrest support members;

wherein the contact surface is generally described by a first axis and a second orthogonal oriented axis; and wherein each respective elongated footrest support member rollingly cooperates with the support surface independently of the other respective footrest support member for movement in horizontal and vertical directions; wherein each footrest support member moves in an elliptical path of motion during use.

15. The exercise machine of claim 14 wherein the first and second rotatable joints are double universal joints.

16. The exercise machine of claim 14 wherein the first and second rotatable joints are ball joints.

17. The exercise machine of claim 14 wherein the first and second rotatable joints are saddle joints.

18. The exercise apparatus of claim 14 wherein each footrest support member has a distal end and a proximal coupled to the means for limiting the motive resistance and travel path; wherein the distal end includes a roller bearing rotatably coupled thereto; wherein the contact surface includes a plurality of intersecting races formed therein; and wherein the races are sized to receive the roller bearing.

19. The exercise apparatus of claim 14 wherein each footrest support member has a distal end and a proximal end coupled to the means for limiting the motive resistance and travel path; wherein the distal end includes a generally flat contact portion; and wherein the contact surface includes an array of roller bearings operationally coupled thereto.

* * * * *